US005687841A

United States Patent [19]

Phykitt

[11] Patent Number: 5,687,841

[45] Date of Patent: Nov. 18, 1997

[54] COMBINATION SHIPPING CONTAINER, MIXING AND DRINKING VESSEL

[75] Inventor: Howard P. Phykitt, Wilson, N.C.

[73] Assignee: Health Corporation, Rocky Mount, N.C.

[21] Appl. No.: 559,003

[22] Filed: Nov. 16, 1995

[51] Int. Cl.[6] ..... B65D 81/00; A61K 31/60

[52] U.S. Cl. ..... 206/217; 206/524.1; 206/534; 206/540

[58] Field of Search ..... 206/217, 216, 206/568, 570, 459.5, 524.1, 528, 534, 540; 383/116

[56] References Cited

U.S. PATENT DOCUMENTS

| | | | |
|---|---|---|---|
| 2,779,462 | 1/1957 | Hoag | 206/217 |
| 2,863,305 | 12/1958 | Shepherd | 206/219 |
| 3,526,317 | 9/1970 | Vanders | 206/217 |
| 3,730,337 | 5/1973 | White | 206/217 |
| 5,064,071 | 11/1991 | Kerfoot, Jr. | 206/534 |
| 5,091,229 | 2/1992 | Golike et al. | 428/35.2 |
| 5,157,030 | 10/1992 | Galat | 514/165 |
| 5,181,610 | 1/1993 | Quick et al. | 383/116 |
| 5,445,856 | 8/1995 | Chaloner-Gill | 428/35.9 |
| 5,492,741 | 2/1996 | Akao et al. | 428/35.2 |

*Primary Examiner*—Paul T. Sewell
*Assistant Examiner*—Luan K. Bui
*Attorney, Agent, or Firm*—James Ray & Assoc.

[57] ABSTRACT

In combination with an alkaline and aspirin combination compound the improvement of a package which serves as both a shipping container for an individual dosage of such medication and at least one of a mixing vessel for mixing such individual dosage with a requisite volume of a liquid solvent and for serving as a drinking cup. The package includes a back portion formed of a material impervious to such liquid solvent and a front portion, also formed of a material impervious to such liquid solvent, overlaying such back portion. Such front portion and such back portion being joined together substantially at a common periphery to form a closed envelope structure with such individual dosage sealed within such closed envelope structure between the front portion and such back portion. This envelope structure adapted to be opened at one edge to convert it to an open-topped envelope structure. Additionally, the front portion and the back portion are adapted to be bowed apart at least sufficient to effect a predetermined volume within such open-topped envelope structure. Such open-topped envelope structure having such volume therein adapted to receive such requisite volume of liquid solvent thereto to be admixed with and dissolve such medication therein and be retained within this open-topped envelope structure.

22 Claims, 1 Drawing Sheet

COMBINATION SHIPPING CONTAINER, MIXING AND DRINKING VESSEL

CROSS REFERENCE TO RELATED APPLICATIONS

This is application is closely related to my co-pending patent application titled, "ALKALINE AND ASPIRIN COMBINATION COMPOUND" which was filed on Nov. 13, 1995 and assigned Ser. No. 08/557,726 and to my co-pending patent application titled, "METHOD FOR PREPARATION OF AN ALKALINE AND ASPIRIN COMBINATION COMPOUND" which was filed on Nov. 13, 1995 and assigned Ser. No. 08/555,900. The teachings in each of these co-pending patent applications are incorporated herein by reference thereto.

FIELD OF THE INVENTION

The present invention relates, in general, to packaging for medications and, more particularly, this invention relates to a package which not only will serve as a shipping container for a granular alkaline and aspirin combination compound, but can also be used to mix the desired volume of a liquid solvent with such granular alkaline and aspirin combination compound to thereby ensure substantially all of the granular alkaline and aspirin combination compound being dissolved and thereafter such package can be used as a drinking vessel for the dissolved alkaline and aspirin combination compound.

BACKGROUND OF THE INVENTION

Aspirin as a suitable treatment for the temporary relief of most minor aches and pain has been well established for many years. In fact, aspirin is still the most commonly used pain relief medication on the market. It is now even being touted as an anti-heart attack and anti-stroke medicine and is considered the number one medication for every type of arthritis. In many cases, aspirin is the drug of choice and is considered the mainstay of arthritis therapy. However, to achieve effective control of inflammation, the cause of arthritis, large daily doses (i.e., in excess of 4,000 mg per day) are needed.

Unfortunately, aspirin is known to have very poor solubility in water and/or any other fluid suitable for human consumption. Since aspirin is virtually insoluble in water (0.33 mg in 100 ml of water) undissolved particles will normally tend to adhere to the gastrointestinal mucosa. Such particle adherence can cause a number of undesirable side effects such as nausea, gastric upset (heartburn) and pain. With the higher aspirin dosages required for the effective treatment of arthritis, these undesirable side effects will generally affect about 25% of the users.

These side effects are topical in nature and generally result from the insolubility of aspirin. The topical nature of these side effects has been established by both gastroscopy and autopsies. Because aspirin is a direct irritant to the gastrointestinal mucosa, its effects are both cumulative and persistent.

Topical side effects do not normally occur, however, when the aspirin is administered in a solution form. While all users of aspirin could benefit from the advantages of its soluble form, older patients are in particular need of such a soluble aspirin product because arthritis is usually a disease of old age. The elderly, as a group, are the largest users of aspirin and, at the same time, they are the most vulnerable to its acute side effects.

As is generally well known, there are some generally soluble aspirin products which are available commercially in both the U.S. and Europe. Unfortunately, the available soluble aspirin products all suffer from one or more shortcomings which have prevented their universal acceptance, especially in the United States. For example, the only commercial product available in the U.S., "Alka Seltzer", contains 567 mg of sodium per 325 mg of aspirin (1,750 mg per 1,000 mg of aspirin).

In order to provide suitable anti-inflammatory activity with Alka Seltzer it would require daily ingestion of more than 7,000 mg of sodium. This amount of sodium intake makes it totally unacceptable for use as aspirin therapy on a regular basis. Not only is this level of sodium extremely high for the population in general, but it cannot be tolerated by many of the elderly arthritics. This is especially the case for those arthritics who may also be on a restricted sodium diet.

The other soluble type aspirin products which are known to be commercially available in Europe either also contain sodium, dissolve incompletely, possess other undesirable side effects and/or could not win FDA approval in the U.S. for some reason. Despite their shortcomings, however, these products still capture a large share of the market for aspirin products in both Europe and Mexico.

Numerous attempts to produce a more soluble aspirin product, in the past, have included salts of sodium, lithium, calcium and magnesium. However, none of these aspirin products were proven to be totally satisfactory. All of them produced at least some undesirable side effects or introduced metals into the system in such large quantities as to make them totally unacceptable for use.

Since the major drawback to the sodium salt is the ingestion of large quantities of sodium, it would seem quite logical that this could be easily avoided by simply adding aspirin granules to the sodium bicarbonate, in premeasured amounts corresponding to the desired dose, to a glass of water, stirring the mixture until the aspirin granules are essentially dissolved and then drinking the solution.

This would provide an aspirin solution which is free of undesirable undissolved particles. And indeed, as mentioned previously, such products are commercially available, usually in the form of an effervescent tablet which contains a mixture of aspirin, sodium bicarbonate and citric acid.

Unfortunately, the major drawback to these products is that in order to accomplish this dissolution, with respect to even the smallest adult dose of aspirin (325 mg, 5 grains) it was found necessary to use a large amount of sodium bicarbonate (1,900 mg), which represents a very large excess, since the theoretical amount of sodium bicarbonate needed is in the order of 152 mg. This is the equivalent to 40 moles when only one mole is needed for the reaction, even allowing for the fact that some of the sodium bicarbonate may be neutralized by the citric acid present in the mixture.

In the laboratory and/or during industrial manufacture, as has been disclosed in U.S. Pat. No. 5,157,030, the amount of sodium bicarbonate used is 46.7 parts per 100 parts of aspirin, whereas in the soluble aspirin tablet described above, this amount is considerably larger. The reason why it is necessary to use such detrimentally large amounts of sodium bicarbonate in such commercial effervescent tablets can generally be explained by the kinetics of the reaction involved.

In the preparation of sodium aspirin, whether such preparation is in the laboratory or on an industrial scale, the amount of water used should be as small as practically possible. Thus, for 100 parts of aspirin and 46.7 parts of sodium bicarbonate, the amount of water should be about 50 parts. Therefore, the amount of aspirin is about 50% of the total, the amount of the sodium bicarbonate is about 25% and the amount of water is about 25% also.

The purpose of using such high concentrations of sodium bicarbonate is to utilize the equipment capacity to its maximum, to produce the maximum yield on crystallization and to use the smallest amount possible of the solvent. Also, the use of high concentrations will result in the reaction being completed in a shorter period of time, since the rate of a chemical reaction is proportional to the product of the concentrations of the reactants.

The concentration of both reactants will vary constantly as the reaction proceeds. The initial concentration of aspirin is low because of its low solubility, whereas that of the much more soluble sodium bicarbonate is about 33%.

The situation is quite different when the use of single doses by individual patients is considered. Aspirin tablets are usually taken with about a half-glass of water (about 100 to 120 ml; about 3 to 4 oz.). While the concentration of aspirin is the same in any amount of water, its value being determined by its solubility in water (0.33%) and is thus constant. The concentration of sodium bicarbonate can be varied as desired within relatively wide limits.

However, if one wishes to use it in equimolar proportions, a 325 mg dose of aspirin will require about 152 mg of sodium bicarbonate to produce a solution. If this dose is taken in 100 ml of water, the concentration of sodium bicarbonate will be, initially, 0.152% and will decrease as the reaction progresses. Thus, the concentration values in the laboratory and/or the plant, on one hand, and in personal usage on the other, are 33% vs 0.15%.

In order to bring the rate of the reaction within more practical limits, and since it is not possible to increase the concentration of aspirin, the only alternative available, prior to the present invention, has been to increase the concentration of undesirable sodium well beyond the stoichiometric proportions. As has been pointed out above, the sodium content of such soluble aspirin products presently available is so high as to make them almost totally unsuitable for most of the major applications of aspirin in medicine.

The influence of sodium bicarbonate concentrations on its rate of reaction with aspirin was determined by stirring 325 mg of aspirin with variable amounts of sodium bicarbonate in 100 ml of water and recording the time needed for the formation of a solution. Aspirin USP mesh #325 was used. This is the finest particle size available commercially (Monsanto, "micronized"). In order to simulate the conditions of practical use as closely as possible, the mixture was stirred by hand and with a teaspoon in an 8 oz glass.

In order to be of practical use to individual patients, a dose of a soluble aspirin product should substantially totally dissolve in about half a glass of water (100–120 ml; 3½–4 oz), in a reasonably short time (less than about 60 seconds), with stirring by hand with a spoon. As mentioned, this is achieved in commercial products by the use of a relatively large excess of sodium bicarbonate. However, this results in the ingestion of excessive amounts of sodium if the product is to be used on a regular basis.

SUMMARY OF THE INVENTION

The present invention provides in combination with a medication including an alkaline and aspirin combination compound specifically formulated for at least temporary relief of minor aches, pains and certain predetermined therapeutic uses, an improved package which serves as both a shipping container for a predetermined individual dosage of such medication and at least one of a mixing vessel for mixing such individual dosage of such medication with a predetermined requisite volume of a preselected liquid solvent and for serving as a drinking cup. The package includes a back portion and a front portion formed of a sheet material impervious to such liquid solvent and having each of a predetermined length and a predetermined width. The front and back portions are joined together substantially at a common periphery to form a closed envelope structure with the individual dosage of the medication sealed within the closed envelope structure. The envelope structure is adapted to be opened closely adjacent one edge to convert the closed envelope structure to an open-topped envelope with the front and back portions adapted to be bowed apart sufficiently to effect a predetermined volume within the open-topped envelope, thus being able to receive a predetermined volume of liquid solvent to be admixed with and dissolve substantially all of the individual dosage of such medication contained in the package and be retained within the open-topped envelope structure.

OBJECTS OF THE INVENTION

It is, therefore, one of the primary objects of the present invention to provide an improved package for use in combination with a medication including an alkaline and aspirin combination compound specifically formulated for at least temporary relief of minor aches, pains and certain predetermined therapeutic uses which serves as both a shipping container for a predetermined individual dosage of the medication and at least one of a mixing vessel for mixing the individual dosage of the medication with a predetermined requisite volume of a predetermined liquid solvent and for serving as a drinking cup.

Another object of the present invention is to form the package of a sheet material that is impervious to a liquid solvent.

Still another object of the present invention is to provide a package in which the front and back portions are joined together substantially at a common periphery to form a closed envelope structure with the individual dosage of medication sealed within the closed envelope.

Yet still another object of the present invention is to provide an envelope so it may be opened at one edge to convert the closed envelope to an open-topped envelope structure, and the front portion and the back portion are adapted to be bowed apart sufficiently to effect a predetermined volume within the open-topped envelope.

Another object of the present invention is to provide a package having an envelope design such that the open-topped envelope structure, having been bowed apart to effect the predetermined volume, is able to receive the predetermined volume of liquid solvent to be admixed with and dissolve the individual dosage of the medication contained therein and be retained within the open-topped envelope.

It is an additional object of the present invention to provide a package in which the envelope containing the solution of the individual dosage of the medication and the liquid solvent is usable as a drinking cup.

Still another object of the present invention is to provide a package having an indicator means incorporated thereon for indicating the desired predetermined level of the liquid solvent.

Yet another object of the present invention is to provide a package in which the front and back sides are joined together with an adhesive on at least three sides of the common periphery to form the closed envelope structure.

Another object of the present invention is to incorporate potassium bicarbonate, coated with a thin layer of potassium carbonate, as the alkaline portion of the alkaline and aspirin combination compound used as the medication.

In addition to the several objects and advantages of the invention which have been described above, various other objects and advantages of the present invention will become more readily apparent to those persons who are skilled in the relevant art from the following more detailed description of the invention, particularly, when such description is taken in conjunction with the attached drawing Figures and with the appended claims.

Figure 1:
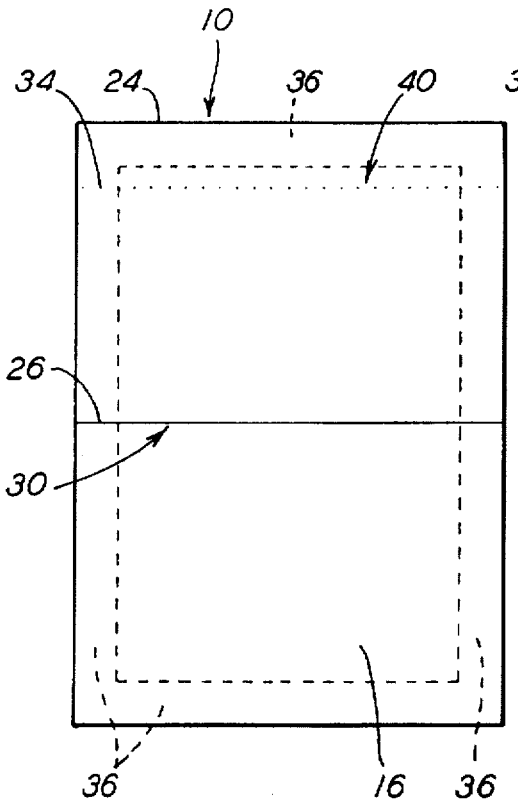
FIG. 1 is an elevation view of the front portion of a presently preferred embodiment of the package for use, in combination with an alkaline and aspirin combination compound, as a shipping container and at least one of a mixing vessel and a drinking cup.

BRIEF DESCRIPTION OF THE PRESENTLY PREFERRED AND VARIOUS ALTERNATIVE EMBODIMENTS OF THE INVENTION

Prior to proceeding to the more detailed description of the present invention, it should be noted that, for the sake of clarity in understanding the invention, identical components having identical functions have been designated with identical reference numerals throughout the drawing Figures.

Figure 2:
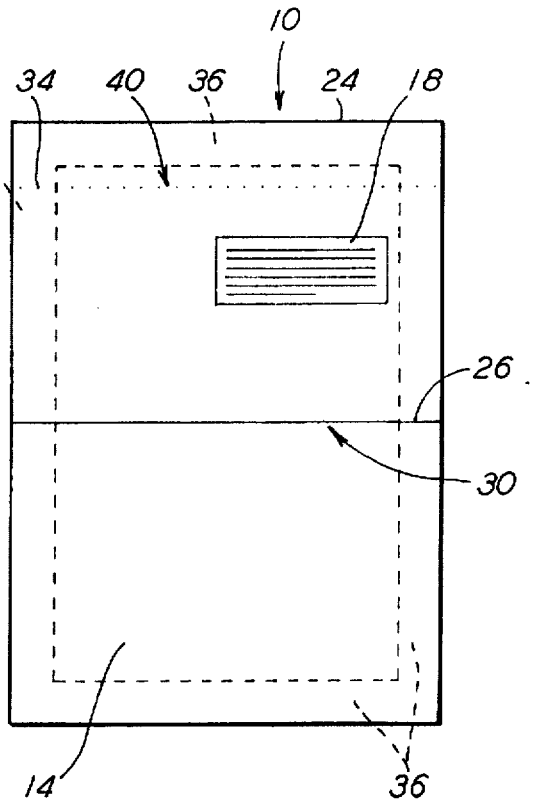
FIG. 2 is an elevation view of the back portion of the package illustrated in FIG. 1.
Figure 3:
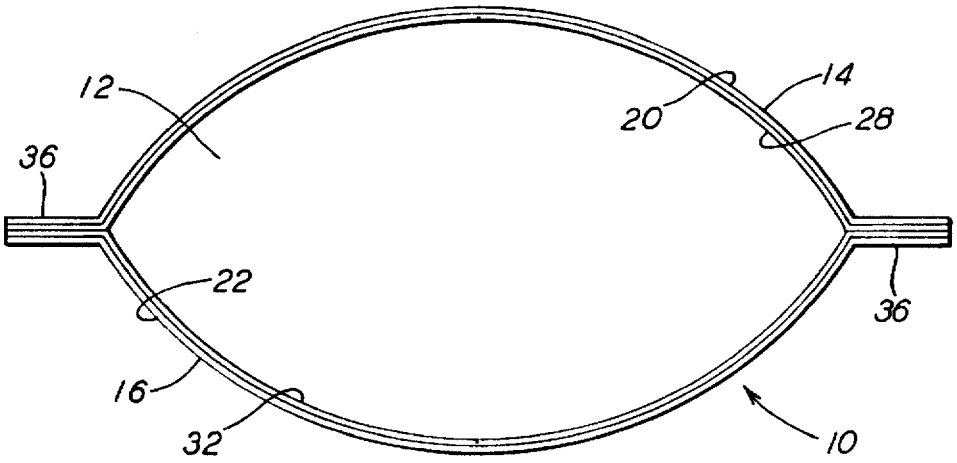
FIG. 3 is a top view of the package as illustrated in FIGS. 1 and 2 with an edge portion removed and bowed to accept a liquid solvent to dissolve the alkaline and aspirin combination compound therein.

Reference is now made more particularly to the drawing FIGS. 1–3. Illustrated therein is a presently preferred embodiment of the invented package, which has been generally designated 10. Such package 10 is designed specifically for use in combination with a medication 12 which includes a granular alkaline and aspirin combination compound specifically formulated for at least temporary relief of minor aches, pains and certain predetermined therapeutic uses.

The improved package 10 serves as both a shipping container for a predetermined individual dosage of the medication 12 and at least one of a mixing vessel for mixing the individual dosage of the medication 12 with a predetermined requisite volume of a predetermined liquid solvent (not shown) and for serving as a drinking cup.

In the presently preferred embodiment, the package 10 includes a back portion 14 formed of a substantially flat and generally flexible sheet material which is impervious to a liquid solvent and having each of a first predetermined length and a first predetermined width.

Package 10 has a front portion 16, also, formed of a substantially flat and generally flexible sheet material which is impervious to such liquid solvent. The front portion 16 of the package 10 overlays the back portion 14 and has a second predetermined length and a second predetermined width.

In one presently preferred embodiment of the invention, the substantially flat and generally flexible sheet material forming such back portion 14 and such front portion 16 of the package 10 is a multilayered sheet containing at least two of a polymer, foil and paper. In this embodiment of the package 10, at least an inner surface 28 and 32, respectively, of each of such back portion 14 and such front portion 16 of the package 10 is a combination of a polymer and foil.

It is preferable that such polymer on each of the back portion 14 and the front portion 16 of such package 10 is "Surlyn", an ionomer resin, commercially available from Dupont and the paper will exhibit a weight of between about 30 pounds and about 40 pounds. It is further preferred that such foil have a thickness of between about 0.4 mil and about 1.3 mils. It is even more preferred that such foil be at least 0.7 mil. This paper weight and foil thickness are preferred because they will provide the requisite amount of stiffness to the package 10 so that it can perform its intended purpose of serving as a mixing vessel and/or drinking cup.

The package 10, in the present invention, preferably further includes at least one of indications, directions, warnings, drug interaction precautions, active ingredients information and storage information 18 on an outer surface 20 and 22, respectively, of one of the back portion 14 and the front portion 16 of the package 10.

It is presently preferred that the indications, directions, warnings, drug interaction precautions, active ingredients and storage information 18 be on the outer surface 20 of the back portion 14 of the package 10.

In the present invention the front portion 16 and the back portion 14 are joined together substantially at a common periphery to form a closed envelope structure. The individual dosage of the medication 12 is sealed within the closed envelope structure between the front portion 16 and the back portion 14.

In the presently preferred embodiment of the invention, the envelope structure of the package 10 is adapted to be opened adjacent one edge 24 to convert the closed envelope into an open-topped envelope structure, and the front portion 16 and the back portion 14 are adapted to be bowed apart (FIG. 3) sufficiently to effect a predetermined volume within the open-topped envelope.

In the present invention the open-topped envelope structure, having been bowed apart to effect the predetermined volume, is ready to receive the predetermined volume of liquid solvent to be admixed with and substantially dissolve all of the individual dosage of the medication 12 contained therein and be retained within the open-topped envelope.

It is presently preferred that the volume of the liquid solvent to be admixed with and substantially dissolve all of the individual dosage of the medication 12 therein is generally between about 1.0 ounce and about 3.0 ounces. Accordingly, the package 10, preferably, further includes an indicator means, generally designated 30, for indicating a level of the predetermined volume of the liquid solvent which will provide about 1.0 to about 3.0 ounces of such liquid solvent in the package 10. Such small volume of liquid solvent being preferred to substantially minimize the volume of foam formed along the upper surface of such liquid solvent while the reaction is taking place.

The indicator means 30, according to the presently preferred embodiment, is a line 26 disposed, respectively, on at least one of an exterior portion 20 and 22 and an interior portion 28 and 32 of at least one of the back portion 14 and the front portion 16 of the package 10. It is preferred that the line 26 be disposed on the exterior portion 20 and 22 of at least one of the back portion 14 and the front portion 16, respectively, of the package 10.

In the instant invention at least the inner surfaces 28 and 32 of each of the back portion 14 and the front portion 16, respectively, of the package 10 are a combination of a polymer and foil.

Additionally, according to the present invention, the first predetermined length and the first predetermined width of the back portion 14 will be substantially equal to the second predetermined length and second predetermined width of the front portion 16 of the package 10. The first and second predetermined lengths are generally in a range of between about 4.0 inches and about 5.5 inches and the first and second predetermined widths of the package 10 are generally in a range of between about 3.0 inches and about 4.0 inches.

The package 10 further includes, in the presently preferred embodiment of the invention, a marking means, generally designated 40, disposed across one of the first and second predetermined widths closely adjacent to the one edge 24 where the package 10 can be opened to form the open-topped envelope structure. In the presently preferred embodiment, the marking means 40 is a line 34.

Preferably, in the present invention the front portion 16 and the back portion 14 of the package 10 are joined together with one of an adhesive 36, which has FDA approval for use in packaging food and/or drugs, and heat treatment on at least three sides of the common periphery to form the closed envelope structure. Such heat treatment be especially preferred. Preferably, all four sides of such common periphery will be joined by one of such adhesive 36 and heat treatment.

Alternatively, according to the present invention, one side of the back portion 14 and an adjacent one side of the front portion 16 of the package 10 may be formed contiguously with one another.

In the presently preferred embodiment of the invention the interior portion of the open-topped envelope structure is sized such that when opened it will hold the liquid solvent generally in a range of between about 3.0 ounces and about 5.0 ounces. It is preferred that the package 10 hold between about 3.0 ounces and about 4.0 ounces of such liquid solvent.

According to the present invention the alkaline portion of the alkaline and aspirin combination compound is a potassium compound and is a combination of a potassium bicarbonate center and with a potassium carbonate outer layer. Preferably, the potassium carbonate is formed as a coating over the potassium bicarbonate.

While a presently preferred and a number of alternative embodiments of the present invention have been described in detail above, it should be understood that various other adaptations and/or modifications of the invention can be made by those persons who are particularly skilled in the drug and/or packaging arts without departing from either the spirit of the invention or the scope of the appended claims.

I claim:

1. In combination with a medication including a potassium bicarbonate, potassium carbonate and aspirin combination compound specifically formulated for at least temporary relief of minor aches, pains and certain predetermined therapeutic uses, the improvement comprising, a package which serves as both a shipping container for a predetermined individual dosage of such medication and a mixing vessel for mixing such individual dosage of such medication with a predetermined requisite volume of a predetermined liquid solvent and as a drinking cup, said package including:

(a) a back portion formed of a first substantially flat and generally flexible sheet material impervious to such liquid solvent and having each of a first predetermined length and a first predetermined width;

(b) a front portion, formed of a second substantially flat and generally flexible sheet material impervious to such liquid solvent, overlaying said back portion and having each of a second predetermined length and a second predetermined width;

(c) said front portion and said back portion being joined together substantially at a common periphery to form a closed envelope structure with such individual dosage of such medication sealed within said closed envelope structure between said front portion and said back portion; and (d) said envelope structure being openable at one edge thereof to convert said closed envelope structure to an open-topped envelope structure, and said front portion and said back portion being bowed apart sufficient to effect a predetermined volume within said open-topped envelope structure, said open-topped envelope structure having said predetermined volume therein for receiving such predetermined requisite volume of liquid solvent thereto to be admixed with and dissolve such individual dosage of such medication therein and be retained within said open-topped envelope structure.

2. The combination, according to claim 1, wherein said predetermined requisite volume of such liquid solvent to be admixed with and dissolve such individual dosage of such medication therein is generally between about 1.0 ounces and about 3.0 ounces and said package further includes an indicator means disposed thereon for indicating a level of such predetermined requisite volume of such liquid solvent.

3. The combination, according to claim 2, wherein said indicator means is a line disposed on at least one of an exterior portion and an interior portion of at least one of said back portion and said front portion of said package.

4. The combination, according to claim 3, wherein said line is disposed on said exterior portion of said at least one of said back portion and said front portion of said package.

5. The combination, according to claim 1, wherein said back portion and said front portion of said package are multilayered containing at least two layers selected from a polymer, foil and paper.

6. The combination, according to claim 5, wherein at least an inner surface of each of said back portion and said front portion of said package is a combination of a polymer layer and a foil layer.

7. The combination, according to claim 6, wherein said polymer layer on each of said back portion and said front portion of said package is an ionomer resin.

8. The combination, according to claim 5, wherein said paper has a weight generally in the range of between about 30 pounds and about 40 pounds.

9. The combination, according to claim 5, wherein said each of said back portion and said front portion of said package includes foil with a thickness generally in a range of between about 0.4 mil and about 1.3 mils.

10. The combination according to claim 9 wherein said thickness of said foil is in a range of between about 0.6 mil and about 0.8 mil.

11. The combination, according to claim 1, wherein said first predetermined length and said first predetermined width of said back portion are substantially equal, respectively, to said second predetermined length and said second predetermined width of said front portion of said package.

12. The combination, according to claim 11, wherein said first predetermined length and said second predetermined length of said package are generally in a range of between about 4.0 inches and about 5.5 inches and said first predetermined width and said second predetermined width of said package are generally in a range of between about 3.0 inches and about 4.0 inches.

13. The combination, according to claim 1, wherein said package further includes a mark disposed across one of said first predetermined width and said second predetermined width closely adjacent said one edge thereof where said package is opened to form said open-topped envelope structure.

14. The combination, according to claim 13, wherein said mark is a line.

15. The combination, according to claim 1, wherein said front portion and said back portion of said package are joined together with at least one of a heat treatment and an adhesive on at least three sides of said common periphery to form said closed envelope structure.

16. The combination, according to claim 15, wherein one side of said back portion and one side of said front portion of said package are formed contiguously with one another.

17. The combination, according to claim 16, wherein said one side of said back portion and said one side of said front portion of said package formed contiguously with one another are disposed along a length of said package.

18. The combination, according to claim 1, wherein an interior portion of said open-topped envelope structure is sized to hold liquid generally in a range of between about 3.0 ounces and about 5.0 ounces.

19. The combination, according to claim 18, wherein said interior portion of said open-topped envelope structure is sized to hold such liquid generally in a range of between about 3.0 ounces and about 4.0 ounces.

20. The combination, according to claim 1, wherein said potassium carbonate is formed as a layer over said potassium bicarbonate.

21. The combination, according to claim 1, wherein said package further includes at least one of indications, directions, warnings, drug interaction precautions, active ingredients information and storage information disposed on an outer surface of one of said back portion and said front portion of said package.

22. The combination, according to claim 21, wherein said package includes each of said indications, said directions, said warnings, said drug interaction precautions, said active ingredients information and said storage information disposed on said outer portion of said back portion of said package.

* * * * *